US011565189B1

(12) United States Patent
Manninen

(10) Patent No.: US 11,565,189 B1
(45) Date of Patent: Jan. 31, 2023

(54) OVERHEAD TEETER TOTTER EQUIPMENT

(71) Applicant: John Manninen, Paradise, CA (US)

(72) Inventor: John Manninen, Paradise, CA (US)

( * ) Notice: Subject to any disclaimer, the term of this patent is extended or adjusted under 35 U.S.C. 154(b) by 0 days.

(21) Appl. No.: 17/820,839

(22) Filed: Aug. 18, 2022

Related U.S. Application Data

(60) Provisional application No. 63/234,554, filed on Aug. 18, 2021.

(51) Int. Cl.
*A63G 11/00* (2006.01)
*A63G 9/00* (2006.01)

(52) U.S. Cl.
CPC ..... *A63G 11/00* (2013.01)

(58) Field of Classification Search
CPC ..... A93G 9/00; A93G 11/00
USPC ..... 472/106, 111, 112, 118, 125, 113
See application file for complete search history.

(56) References Cited

U.S. PATENT DOCUMENTS 1,207,399 A * 12/1916 Hardy ..... A63G 11/00 472/108
1,402,368 A * 1/1922 Mongillo ..... A63G 11/00 482/44
2,603,272 A * 7/1952 Rowand ..... A63G 9/12 248/165
3,664,665 A * 5/1972 Scott ..... A63G 1/20 472/20
5,951,406 A * 9/1999 Steane ..... A63G 11/00 472/111

* cited by examiner

*Primary Examiner* — Kien T Nguyen
(74) *Attorney, Agent, or Firm* — Maschoff Brennan

(57) ABSTRACT

A device may include a vertical pole, and a horizontal pole suspended at a top end of the vertical pole. The device may also include a mechanical pivot point between the vertical pole and the horizontal pole, and a handgrip suspended at a distal end of the horizontal pole. The device may also include a first chain suspended from the horizontal pole between the handgrip and the mechanical pivot point. The device may additionally include a mechanical device to removably couple the first chain to the handgrip such that when the first chain is coupled to the handgrip, a heavier user is able to use the device compared to when the first chain is not coupled to the handgrip.

20 Claims, 4 Drawing Sheets

OVERHEAD TEETER TOTTER EQUIPMENT

CROSS-REFERENCE TO RELATED APPLICATIONS

This application claims the benefit of U.S. Patent Application Ser. No. 63/234,554, filed on Aug. 18, 2021; the disclosure of which is incorporated herein by reference in its entirety.

FIELD

The present disclosure relates generally to overhead teeter totter equipment.

BACKGROUND

Various exercise or play devices are known and have been around for years. For example, many children have used teeter totters where one child goes up, while the other goes down, while sitting on a board or plank balanced on a fulcrum. However, there are improvements that may be beneficial to such devices.

The subject matter claimed in the present disclosure is not limited to embodiments that solve any disadvantages or that operate only in environments such as those described above. Rather, this background is only provided to illustrate one example technology area where some embodiments described in the present disclosure may be practiced.

SUMMARY

One or more embodiments of the present disclosure may include a device that may include a vertical pole, and a horizontal pole suspended at a top end of the vertical pole. The device may also include a mechanical pivot point between the vertical pole and the horizontal pole, and a handgrip suspended at a distal end of the horizontal pole. The device may also include a first chain suspended from the horizontal pole between the handgrip and the mechanical pivot point. The device may additionally include a mechanical device to removably couple the first chain to the handgrip such that when the first chain is coupled to the handgrip, a heavier user is able to use the device compared to when the first chain is not coupled to the handgrip.

The object and advantages of the embodiments will be realized and achieved at least by the elements, features, and combinations particularly pointed out in the claims. It is to be understood that both the foregoing general description and the following detailed description are explanatory and are not restrictive of the invention, as claimed.

DETAILED DESCRIPTION

Currently, there are some options for an overhead exercise or playground equipment which have functions similar to that of a teeter totter, sometimes called a seesaw. Some of these options attempt to provide good exercise, but they fail to meet the needs of the industry because the users are seated and can only use their leg muscles. Other options attempt to provide a safe user environment, but do not keep the equipment high enough to prevent some of the moving parts from striking the users or spectators. Still other options attempt to allow for physically different users, but do not take into consideration the differences in height and weight and provide an easy method/device to allow the users to adjust for physical differences. Still other options seek to provide shock absorption, but these options also fail to meet industry needs because they do not store mechanical energy, which provides shock absorption and full use of the stored energy to provide a more active exercise device.

It may be desirable to provide an exercise device which engages the whole body in exercise not just the legs or arms. Furthermore, it may be desirable using a mechanical energy storage device that one or two people can use it at the same time. Still, further, it may be desirable to have a device that allows to people with different physical characteristics to engage together in exercise, such as a parent and child. In one or more embodiments of the disclosed device, these needs may be advantageously filled and/or the aforementioned deficiencies may be addressed by providing an exercise device that permits the participant to pull downward and jump upward, with adjustments made for different heights and weights of the participants.

Embodiments of the present disclosure will be explained with reference to the accompanying drawings.

Figure 1:
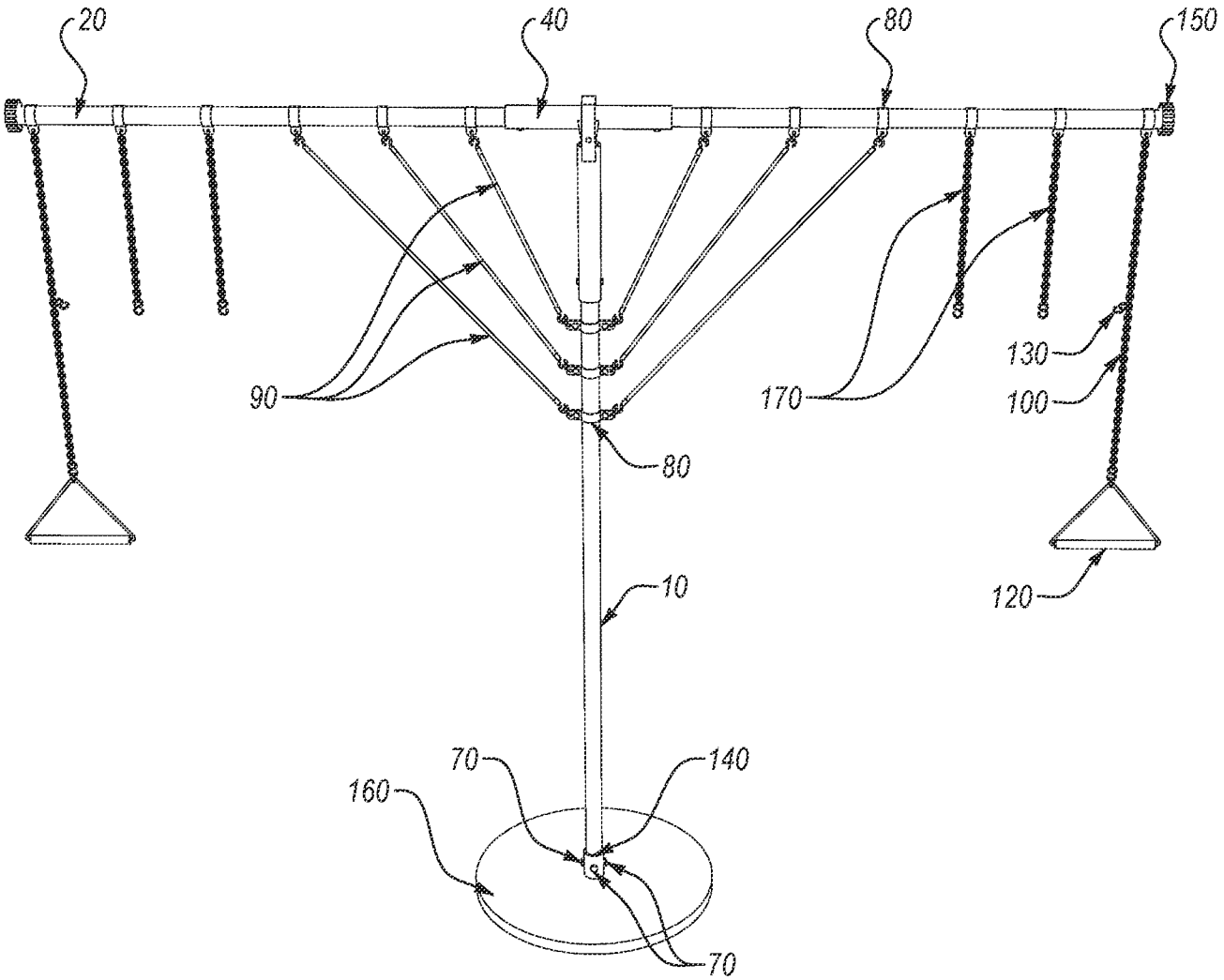
FIG. 1 illustrates a perspective view of an example overhead teeter totter style exercise equipment.

FIG. 1 illustrates a perspective view of an example overhead teeter totter style exercise equipment or device. The exercise device may include an overhead teeter totter style exercise device, which may include the following components: a physically secured vertical pole (10), a horizontal pole (20) whose center may be attached to said vertical pole via a mechanical pivot point (30), and two chains (100) or similar components suspended one from each distal end of the horizontal pole (20) which are attached to a handgrip (120). These components may be connected as follows: the vertical pole (10) may be physically secured at its bottom by mechanical means, such as directly embedded in concrete (160). At the top of the vertical pole may be a pivot point (30) mechanically attached to the vertical (10) and horizontal pole (20) using bolts (70) or welded connections. At or near the distal ends of the horizontal pole (20) are members (100) suspended downward connected to user handgrips (120), where each may be at opposite distal ends of the horizontal pole (20).

The device may also have one or more of the following: (a) a pivot point assembly containing a vertical frame (50) a horizontal frame (40) bracket assembly (60) and the pivot point (30); (b) mechanical energy storage device(s) (90) such as but not limited to, springs, elastic bands or bungee cords, among others; (c) fixed attachment brackets (85) or adjustable attachment brackets (80) for attaching mechanical energy storage device (90) or chains (100) to the exercise device; (d) multiple locations on the horizontal pole (20) closer to the center for attachment brackets (80) for additional chains (100); (e) attached "S" hook or hooks (130) on chains (100); (f) the vertical pole (10) may be attached at the bottom end to a ground sleeve (140) embedded in concrete (160) and/or secured with bolts (70).

The disclosed device may provide: (1) user handgrips, which allow a user to physically engage in a full body exercise; (2) a simple, easy device to compensate for differences in height and weight between two users; and (3) a device that stores energy continuously throughout a full range of movement to provide a rebound effect similar to that of a trampoline.

In some embodiments, the height of the movable horizontal bar may be selected prevents injuries. Additionally or alternatively, the use of a handgrip may allow for greater physical exercise compared to a teeter totter upon which the user sits down. Additionally or alternatively, simple to use "S" hooks or other mechanical linkages may provide a quick and easy way to correct for differences in users' heights and/or weights. Additionally or alternatively, mechanical energy storage devices may allow for a continuous rebound effect by one or both users over the full spectrum of movement, and may not be used just for shock absorption. Such mechanical energy storage devices may also be adjustable for different effects, including one-person use.

The present disclosure will now provide a more detailed and specific description that will refer to the accompanying drawings. The drawings and specific descriptions of the drawings, as well as any specific or alternative embodiments discussed, are intended to be read in conjunction with the entirety of this disclosure. The present disclosure may be embodied in many different forms and should not be construed as being limited to the embodiments set forth herein; rather, these embodiments are provided by way of illustration only and so that this disclosure will be thorough, complete and fully convey understanding to those skilled in the art.

In one embodiment, the device may include a rigid vertical pole (10). The vertical pole (10) may be tall enough to suspend a rigid horizontal pole (20) high enough to prevent anyone on the ground from being struck by it, and on the lower end, the vertical pole (10) may be physically held in place by a sleeve (140), which may embedded in concrete (160) and secured by bolts (70), thus allowing to be easily installed, removed or repaired. In some embodiments, the height of the vertical pole may include five feet, six feet, seven feet, eight feet, ten feet, twelve feet, or any ranges therebetween, such as between five feet and twelve feet, between six feet and ten feet, or any other heights.

In some embodiments, the device may include a pivot point assembly including a sleeve (45) and frame (50) which may be slipped over and attached to the vertical pole (10) and secured using bolts (70). Horizontal sleeve (40) may be attached to frame (60) that may include a round hole and sleeve for a pivot point bolt (30). The horizontal sleeve (40) may slip over a rigid horizontal pole (20) and may be secured by bolts (70). In some embodiments, the attachment brackets (80) may be secured near the ends of the rigid horizontal pole (20), which suspend chains (100) down and attach to user handgrips (120).

In some embodiments, the device may include "S" hook(s) (130), one side of which may be permanently attached to the suspended chain (100), and the other side may allow a user to take slack out of the suspended chain (100) to compensate for different height users. For example, by attaching the "S" hook of the chain closest to the handgrip (120), the chain (100) from which the handgrip (120) is suspended may be shortened such that a taller user is able to use the handgrip (120) to use the device. Additionally or alternatively, the "S" hook (130) of the chain (100) from which the handgrip (120) is suspended may be coupled to the horizontal pole (20) such that the handgrip (120) is suspended higher than when the chain (100) is able to hang free.

In some embodiments, additional suspended chains (100) may be attached to the horizontal pole (20) closer to the center to allow the "S" hook (130) on the first suspended chain (100) that has the handgrip (120) to attach to the chains closer to the center, thereby compensating for the weight of a heavier user. For example, by shifting where the weight is applied to the horizontal pole (20), the dynamic of balancing about the pivot point changes. For example, a heavier weight closer to the pivot point will be balanced by a lighter weight further away from the pivot point.

In some embodiments, mechanical energy storage device(s) (90) may be attached to both the vertical and horizontal poles using the adjustable brackets (80). In these and other embodiments, one or more of these energy storage devices (90) may be installed, including several (such as three, four, five, six, seven, or more). In some embodiments, the mechanical energy storage device(s) (90) may be attached in singular, in parallel, in series, or in any combinations thereof to facilitate a user's rebound experience much like that of a trampoline effect and may be configured to allow for a one-person usage. For example, a sufficient number, combination, or strength of energy storage devices (90) may be located on a side opposite of a handgrip (120) such that as the single user utilizes the device, the rebound forces pulls the user upwards. In some embodiments, the rebound force for the single user may be an assistive pull such that the user still uses some of their own effort to move back upward, while other times the rebound force may be stronger (e.g., strong enough to pull the single user off the ground).

Continuing the description of FIG. 1, FIG. 1 shows an overall view of the overhead exercise equipment, starting with the foundation, which may be embedded in cement (160) and may or may not contain a sleeve (140) and may be fastened with bolts (70), that may facilitate installation and removal of the vertical pole (10). The vertical pole (10) may be directly embedded in cement (160), or other means of anchoring. The vertical pole (10) is connected to a pivot point assembly shown in more detail on FIG. 3. The rigid horizontal pipe (20) can be constructed to be one piece that is slipped through the pivot point assembly sleeve (40). Or the rigid horizontal pipe (20) can be two separate sections attached to the pivot point assembly sleeve (40) by means such as but not limited to bolts, threads, welding, rivets, or any other coupling technique. At the outer ends of the rigid horizontal pipe (20) are suspended chain(s) (100) using an attachment method such as but not limited to an adjustable bracket (80), or a fixed bracket that is bolted or welded in place. The suspended chain(s) (100) may be coupled to personal handgrips (120).

One or more mechanical energy storage devices (90) may be connected to an adjustable bracket (80). One end of such mechanical energy storage devices (90) may be attached to the vertical pole (10) and the other end to the horizontal pole (20). Also shown are weight compensating chains (170) suspended from rigid horizontal pipe (20) near the outside ends. "S" hooks (130) may be used to adjust lengths of suspended chains (100) for different heights of users. "S" hooks (130) may also be used to connect to the weight compensating chain (170) for different weight of users.

In operation, a user on each side may grasp the handgrips (120). A first user may lift their feet up or otherwise pull the horizontal pole (20) downwards towards the user. As the horizontal pole (20) is pulled downwards on one side of the pivot point, the other side goes upwards, pulling a second user upwards as they hold onto the second handgrip (120). Based on the weight of the second user pulled upwards, gravity, and/or any mechanical energy storage devices (90), after being pulled upwards, the second user is pulled downwards. This causes a corresponding upwards pull on the first user holding on to the first handgrip (120). Use of the devices progresses back and forth, alternating pulling the first user downwards and upwards and the second user upwards and downwards.

Figure 2:
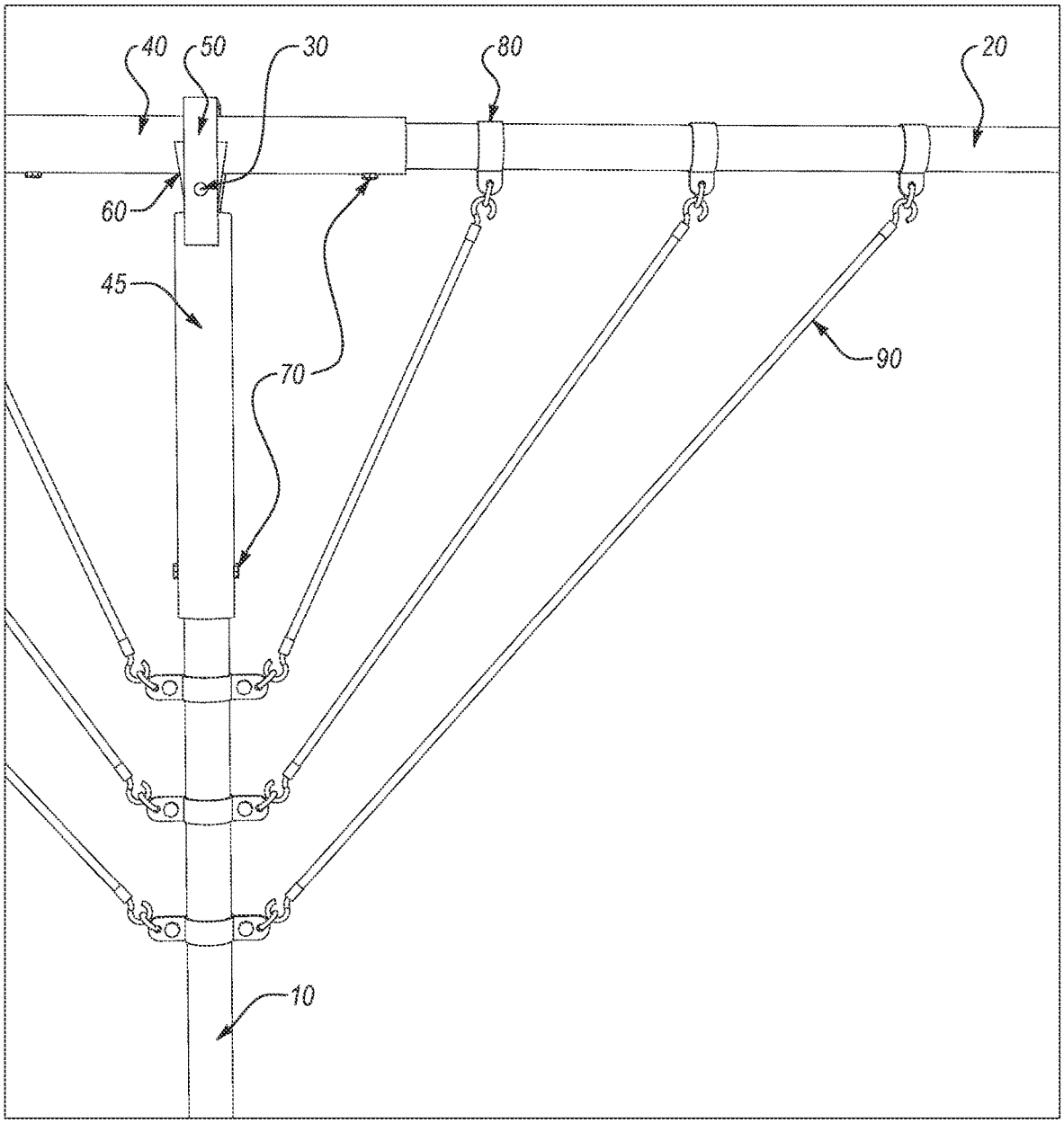
FIG. 2 illustrates a closeup view of an example pivot point assembly and an example mechanical energy storage device.

FIG. 2 shows a close-up view of the pivot point assembly and the mechanical energy storage devices (90). The pivot point assembly may include the vertical sleeve (45) and attached frame (50), the horizontal sleeve (40), an attached frame (60), and/or a pivot point bolt (30). The sleeves (40) and (45) may include a safe means of attachment that could prevent parts from detaching and falling onto users. Such sleeves may also facilitate field assembly. For example, it may be easier and more straightforward to place the poles into the sleeves than trying to attach them directly to each other and/or to mount them in the ground. The pivot point assembly may be made in a factory for better quality control and ease of assembly in the field. The energy storage devices (90) can be constructed of many different elastic materials such as but not limited to steel springs, elastic, or rubber. Sizes such as diameter or lengths, and other properties can vary to adjust the rebound force. Additionally or alternatively, the number and configuration of the energy storage devices (90) added in parallel and/or in series may be used to compensate for different users' weights and energy levels. In these and other embodiments, the energy storage devices (90) may be preferably attached to the vertical and horizontal members using an adjustable bracket (80), which allows for adjustment depending on the length of the energy storage devices (90), but can be attached to fixed anchor points such as eyebolts or welded rings. In some embodiments, the number and/or configuration of the energy storage devices (90) may be adjusted based on the weight of the different users and/or a single user utilizing the device.

In some embodiments, a combination of the energy storage devices (90) and the chains 170 may be utilized to offset a heavier user of the device. For example, a parent using the device with their child may couple one or more of the chains 170 to the handgrip 120 on the parent's side via the "S" hook 130 and also attach additional energy storage devices (90) on the child's side.

Figure 3:
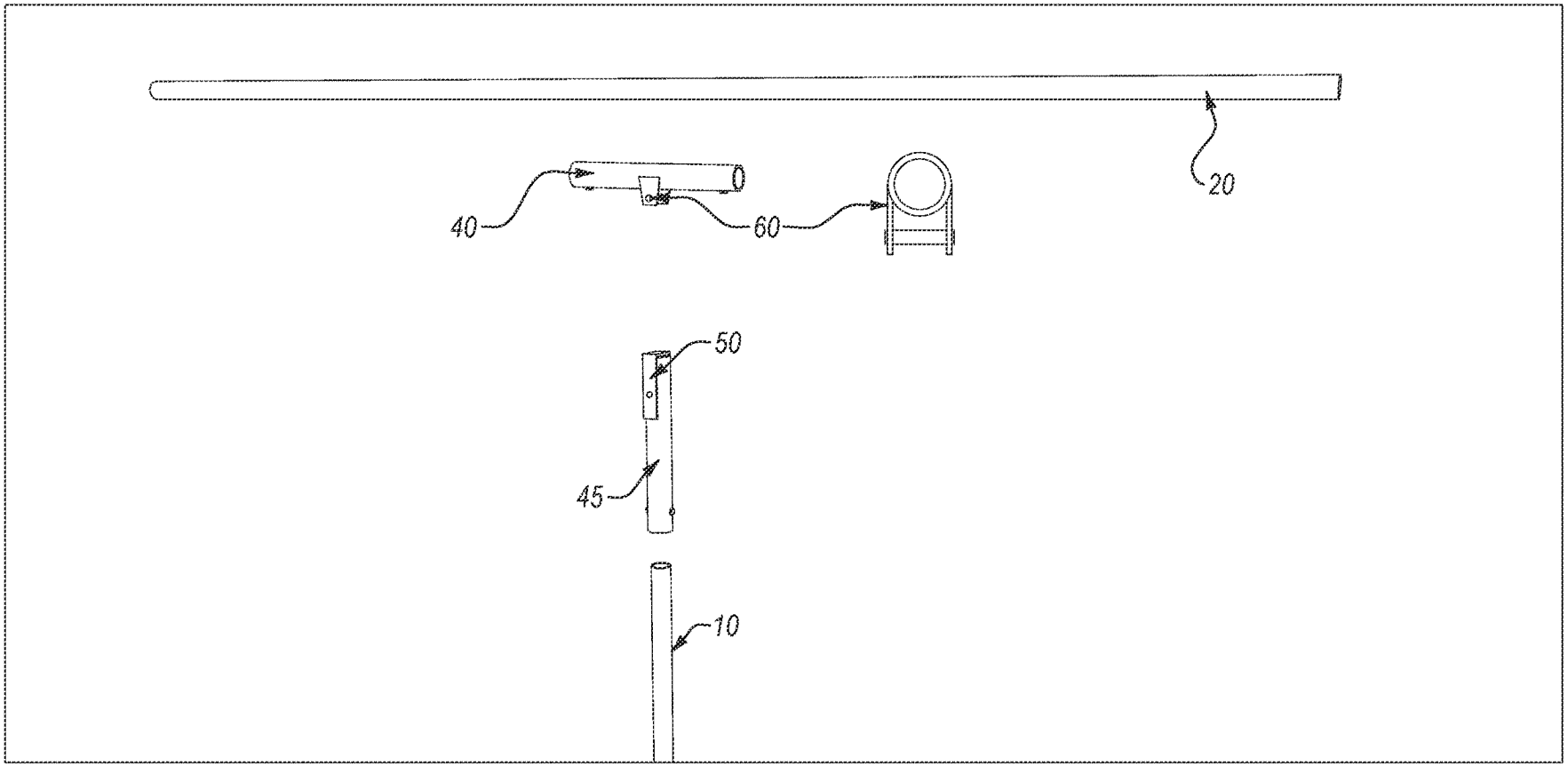
FIG. 3 illustrates an exploded view of the example pivot point assembly of FIG. 2 and example vertical and horizontal beams.

FIG. 3 shows an exploded view of the pivot point assembly. Vertical pole (10) may be slipped inside the vertical sleeve (45), which may include a frame (50) (e.g., the frame (50) may be welded on the top portion of the vertical pole (10)). Horizontal pole (20) may be slipped through the horizontal sleeve (40), which may include a frame (60) which may be welded on the midsection of the horizontal pole (20). Frame (60) may slide through frame (50) and may be attached using the pivot point bolt (30) (not shown).

In some embodiments, rather than having the horizontal pole (10) being centered in the horizontal sleeve (40), if one side is expected to be frequently used by a heavier user, the horizontal pole (10) may be offset from center such that one distal end is longer than the other relative to the pivot point and the horizontal sleeve (40).

Figure 4:
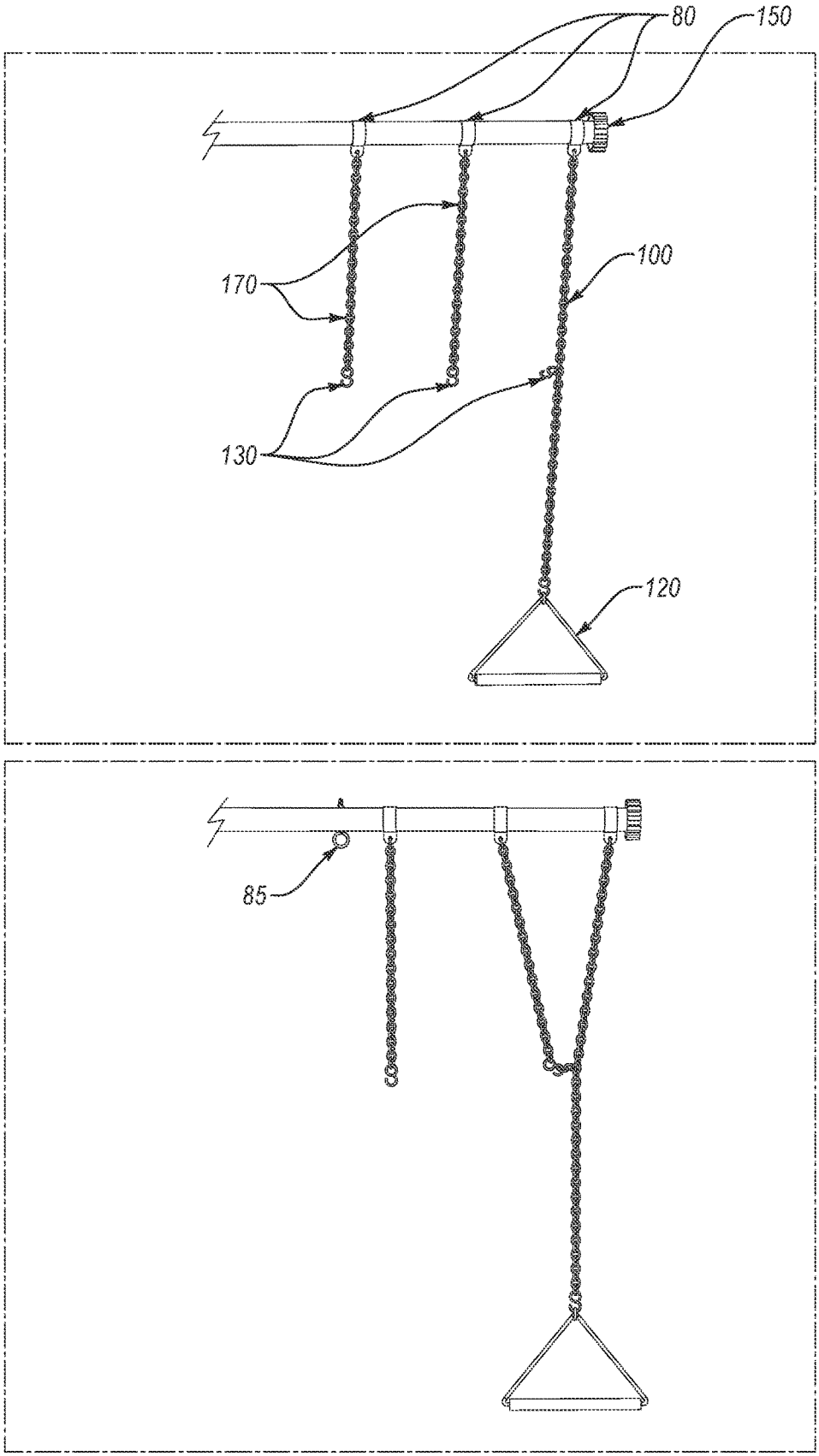
FIG. 4 illustrates a side view of an example of the equipment showing the use of an example "S" hook to facilitate adjusting for a weight difference on one side of an example overhead teeter totter style exercise equipment.

FIG. 4 shows two views of the attachment point of the personal handgrips (120). In the upper figure, personal handgrip (120) may be attached to a suspended chain (100), or a suspended cable or a combination of both and is attached to the horizontal pole (20) with an adjustable bracket (80). A suspended chain/cable combination might be desirable to prevent the "S" hook from being attached too high on a suspended chain, which would make it difficult for the next user to access the personal handgrip (120). Suspended chains (170) are positioned closer to the center on horizontal pole (20) to provide a method to compensate for heavier weighted users. In the lower figure, by using the "S" hook (130) and attaching it to a suspended chain (170), it relocates the center of gravity on horizontal pole (20) closer on one side to the center thereby offsetting the weight difference of the users. An "I" bolt (85) or a welded metal ring can be used instead of adjustable bracket (80). End cap (150) is used to keep rain and insects out.

In some embodiments, the "S" hook of the chain (100) may be attached to the adjustable bracket (80) to shorten the length of the chain (100) for a taller user. In some embodiments, both (or more) of the chains (170) may be coupled to the handgrip via the "S" hook of the chain (100) to offset the weight of the user. For example, the first "S" hook (130) may be coupled to the chain (100) at the "S" hook (130) of the chain (100), and the second "S" hook (130) of the chain (170) may be coupled to the first "S" hook (130) of the first chain 170 and/or the "S" hook (130) of the chain (100).

In some embodiments, the "S" hook (130) of the chain (100) may be partially along the length of the chain (100) such that there is still a span of the chain (100) between the "S" hook (130) and the handgrip (120). In some embodiments, the "S" hook (130) may be located approximately halfway along the length of the chain (100). In some embodiments, the "S" hook (130) may be at approximately the same length as the "S" hook (130) of the chain(s) (170). In these and other embodiments, the chain(s) (170) may be shorter than the chain (100).

While typically described herein as being a "chain," it will be appreciated that a cable, a rope, or any other similar or comparable length of material or of joined components (like chain links) may be used and is contemplated within the scope of the present disclosure.

Unless specific arrangements described herein are mutually exclusive with one another, the various implementations described herein can be combined to enhance system functionality or to produce complementary functions. Likewise, aspects of the implementations may be implemented in standalone arrangements. Thus, the above description has been given by way of example only and modification in detail may be made within the scope of the present disclosure.

With respect to the use of substantially any plural or singular terms herein, those having skill in the art can translate from the plural to the singular or from the singular to the plural as is appropriate to the context or application. The various singular/plural permutations may be expressly set forth herein for sake of clarity. A reference to an element in the singular is not intended to mean "one and only one" unless specifically stated, but rather "one or more." Moreover, nothing disclosed herein is intended to be dedicated to the public regardless of whether such disclosure is explicitly recited in the above description.

In general, terms used herein, and especially in the appended claims (e.g., bodies of the appended claims) are generally intended as "open" terms (e.g., the term "including" should be interpreted as "including but not limited to," the term "having" should be interpreted as "having at least," the term "includes" should be interpreted as "includes but is not limited to," etc.). Furthermore, in those instances where a convention analogous to "at least one of A, B, and C, etc." is used, in general, such a construction is intended in the sense one having skill in the art would understand the convention (e.g., "a system having at least one of A, B, and C" would include but not be limited to systems that include A alone, B alone, C alone, A and B together, A and C together, B and C together, or A, B, and C together, etc.). Also, a phrase presenting two or more alternative terms, whether in the description, claims, or drawings, should be understood to include one of the terms, either of the terms, or both terms. For example, the phrase "A or B" will be understood to include the possibilities of "A" or "B" or "A and B."

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed is:

1. A device, comprising:

a vertical pole;

a horizontal pole suspended at a top end of the vertical pole;

a mechanical pivot point between the vertical pole and the horizontal pole;

a handgrip suspended at a distal end of the horizontal pole;

a first chain suspended from the horizontal pole between the handgrip and the mechanical pivot point; and a mechanical device to removably couple the first chain to the handgrip.

2. The device of claim 1, wherein the mechanical pivot point comprises a pivot point assembly, the pivot point assembly comprising:

a first sleeve interfacing with the horizontal pole;

a second sleeve interfacing with the vertical pole; and a frame projecting vertically up from the second sleeve and supporting the first sleeve, wherein the frame acts as the mechanical pivot point between the vertical pole and the horizontal pole.

3. The device of claim 2, wherein the frame comprises a bracket which suspends the first sleeve above the vertical pole.

4. The device of claim 1, further comprising:

a first attachment bracket via which the handgrip is suspended from the horizontal pole; and a second attachment bracket via which the first chain is suspended from the horizontal pole.

5. The device of claim 4, further comprising:

a second handgrip suspended from a second distal end of the horizontal pole opposite the distal end from which the handgrip is suspended;

a second chain suspended from the horizontal pole between the second handgrip and the mechanical pivot point; and a second mechanical device to removably couple the second chain to the second handgrip.

6. The device of claim 5, further comprising:

a third chain suspended from the horizontal pole between the second chain and the mechanical pivot point; and a third mechanical device to removably couple the third chain to the second chain or to the second handgrip such that when the third chain is coupled to the second handgrip or to the second chain, the second handgrip is configured to support more weight than (1) when the second handgrip is not coupled to the second chain or the third chain, and (2) when the second handgrip is coupled to the second chain and not coupled to the third chain.

7. The device of claim 1, further comprising:

a first horizontal attachment bracket coupled to the horizontal pole and a first vertical attachment bracket coupled to the vertical pole;

a first mechanical energy storage device removably suspended between the first horizontal attachment bracket and the first vertical attachment bracket;

a second horizontal attachment bracket coupled to the horizontal pole and a second vertical attachment bracket coupled to the vertical pole; and a second mechanical energy storage device removably suspended between the second horizontal attachment bracket and the second vertical attachment bracket, wherein the first mechanical energy storage device is shorter than the second mechanical energy storage device, and wherein a rebound force of the device is adjustable by coupling one or both of the first mechanical energy storage device to the first horizontal attachment bracket and the first vertical attachment bracket and the second mechanical energy storage device to the second horizontal attachment bracket and the second vertical attachment bracket.

8. The device of claim 7, wherein the first mechanical energy storage device includes at least one of a spring, an elastic band, or a bungee cord.

9. The device of claim 7, wherein the first mechanical energy storage device is coupled to the horizontal pole on an opposite side of the horizontal pole from the handgrip, and wherein one or more mechanical energy storage devices including the first mechanical energy storage device provide a rebound effect to a single user operating the device via the handgrip.

10. The device of claim 1, wherein the vertical pole is coupled to a ground sleeve that is anchored to the ground.

11. The device of claim 1, further comprising:

a handgrip chain via which the handgrip is suspended from the horizontal pole, the handgrip chain longer than the first chain;

wherein the first chain is indirectly coupled to the handgrip via the first chain being removably coupled to the handgrip chain along a first length of the handgrip chain such that a second length of the handgrip chain remains between where the first chain is coupled to the handgrip chain and the handgrip.

12. The device of claim 11, further comprising a second mechanical device for removably coupling the handgrip chain to the horizontal pole such that when coupled to the horizontal pole, the handgrip is suspended at a higher height than when the second mechanical device is not coupled to the horizontal pole.

13. A method comprising:

removably coupling a chain of a device to a handgrip of the device, the handgrip suspended from a distal end of a horizontal pole of the device, the horizontal pole supported at an end of a vertical pole at a pivot point between the horizontal pole and the vertical pole, the chain suspended from the horizontal pole between the handgrip and the pivot point, the device including one or more mechanical energy storage devices coupled to both the horizontal pole and the vertical pole, the device configured to be used by a user when the chain is removably coupled to the handgrip; and using the device by the heavier user.

14. The method of claim 13, further comprising removably coupling an additional mechanical energy storage device to both the horizontal pole and the vertical pole on a same side of the pivot point as the handgrip, a number of total mechanical energy storage devices based on a weight of the user.

15. The method of claim 13, further comprising uncoupling a second chain from a second handgrip based on a second user different from the user using the device via the second handgrip, the second handgrip and the second chain suspended from the horizontal pole on an opposite side of the horizontal pole than the handgrip relative to the pivot point.

16. The method of claim 13, wherein the user is a single user utilizing the device.

17. A device, comprising:

a vertical pole;

a horizontal pole suspended at a top end of the vertical pole;

a mechanical pivot point between the vertical pole and the horizontal pole;

a first handgrip suspended at a first distal end of and below the horizontal pole;

a second handgrip suspended at a second distal end of and below the horizontal pole, the second distal end opposite the first distal end;

a first plurality of mechanical energy storage devices coupled to both the horizontal pole and the vertical pole towards the first distal end of the horizontal pole relative to the mechanical pivot point; and a second plurality of mechanical energy storage devices coupled to both the horizontal pole and the vertical pole towards the second distal end of the horizontal pole relative to the mechanical pivot point.

18. The device of claim 17, wherein a first of the first plurality of mechanical energy storage devices is coupled closest to the mechanical pivot point for both the vertical pole and the horizontal pole, and a second of the first plurality of mechanical energy storage devices is coupled furthest from the mechanical pivot point for both the vertical pole and the horizontal pole.

19. The device of claim 17, further comprising:

a chain suspended from the horizontal pole between the first plurality of mechanical energy storage devices and the first handgrip; and a mechanical linkage for removably coupling the chain to the first handgrip.

20. The device of claim 19, further comprising a handgrip chain via which the handgrip is suspended from the horizontal pole, wherein the chain is indirectly coupled to the first handgrip via the mechanical linkage coupling partially along a length of the handgrip chain such that a span of the handgrip chain remains between where the mechanical linkage couples with the handgrip chain and the handgrip.

* * * * *